United States Patent [19]

Harris

[11] 4,429,788

[45] Feb. 7, 1984

[54] CONTAINER FOR OIL CAN SPOUT

[76] Inventor: Dennis J. Harris, 717 W. 53rd St., Davenport, Iowa 52806

[21] Appl. No.: 457,297

[22] Filed: Jan. 11, 1983

[51] Int. Cl.[3] ..... B65D 85/00; F16C 3/14; F16M 33/00; B65B 3/04

[52] U.S. Cl. ..... 206/349; 184/1.5; 184/105 R; 141/330; 222/88; 206/229

[58] Field of Search ..... 206/349, 229, 527, 526; 184/1.5, 105 R, 106; 141/330; 222/88

[56] References Cited

U.S. PATENT DOCUMENTS

| | | | |
|---|---|---|---|
| 130,762 | 8/1872 | Strickler . | |
| 777,670 | 12/1904 | Frazer . | |
| 949,074 | 2/1910 | Hickox . | |
| 1,148,084 | 7/1915 | Dorn . | |
| 2,071,944 | 2/1937 | Hoffman | 222/88 |
| 2,114,459 | 4/1938 | Wiswell | 184/105 R |
| 2,130,085 | 9/1938 | Harks | 184/105 R |
| 2,238,253 | 4/1941 | Dick | 206/229 |
| 3,524,534 | 8/1970 | Browner | 220/20 |
| 3,934,623 | 1/1976 | Hays | 141/330 |

*Primary Examiner*—William T. Dixson, Jr.
*Attorney, Agent, or Firm*—Henderson & Sturm

[57] ABSTRACT

A container for an oil can spout of the type having a lower can-piercing end and an upper pouring end. The container has a bottom, side walls structure and an open top, all dimensioned so that the spout is receivable by the container with its lower end down and its upper end adjacent the top of the container. Lid structure closes the container, but the lid is selectively movable to an open position to enable insertion and removal of the spout. A support is provided within the container for relatively tightly receiving the lower end of the spout and a bottom oil reservoir receives oil draining from the spout after use. The reservoir has an oil drain for draining oil from the reservoir. The container may be mounted in a vehicle or on any appropriate support by a bracket and strap device. A seal is used between the lid and the top of the container to prevent passage of dirt and oil.

7 Claims, 13 Drawing Figures

FIG. 1
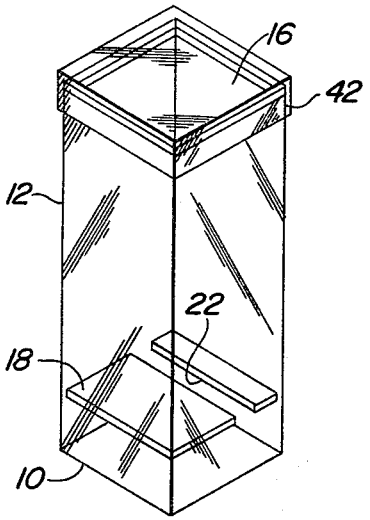
FIG. 2
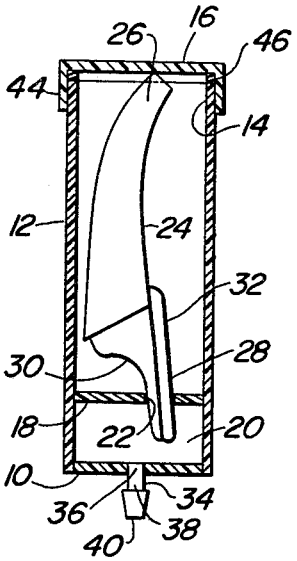
FIG. 4
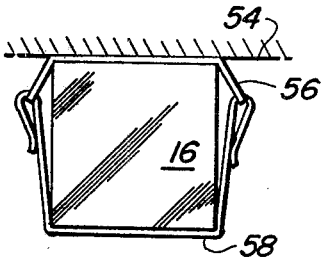
FIG. 9
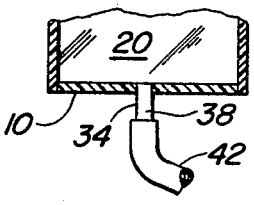
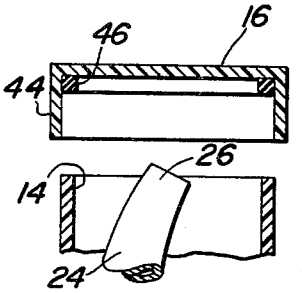
FIG. 3
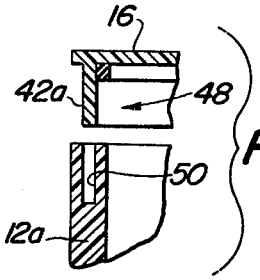
FIG. 7
FIG. 8
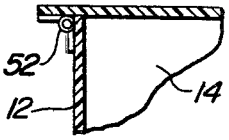
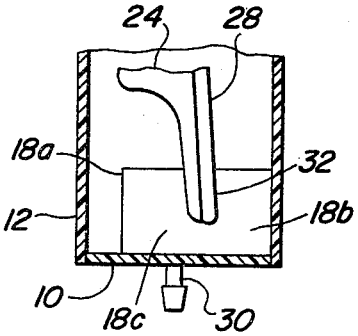
FIG. 5
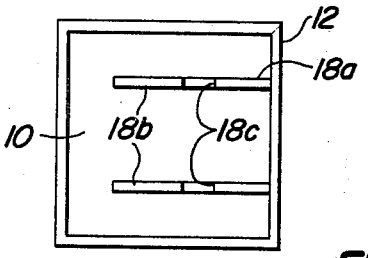
FIG. 6

CONTAINER FOR OIL CAN SPOUT

BRIEF SUMMARY OF THE INVENTION

Many automobile and truck owners prefer to change their own engine oil and/or to add oil as needed because they find that it is more economical and in most cases more convenient. Typically, engine oil is purchased in quart cans and a can-piercing spout is used for pouring the oil into the engine filler. The conventional spout has a bifurcated lower end including a cutter which penetrates the top of the can and an outer leg which rather tightly fits the outside wall of the can so that the spout temporarily becomes part of the can. When the can is emptied, the spout is removed and the can discarded.

The problem to be solved is that concerned with storage of the spout until it is needed again. After the spout is removed, some oil will of course remain in the upper part of the spout as well as in the lower can-piercing part or leg. If the used spout is simply placed on a shelf or hung on a wall it is exposed to dirt and dust and the oil drains or drips off. For the sake of good order, the spout must be carefully cleaned before it can be used again. Some owners find it convenient to stand the spout up in some form of open-top can or the like, which partly solves the drip problem but still leaves the oily spout exposed to dust and dirt. Further, the oil collects in the bottom of the container and becomes contaminated. Even if the can is covered, the accumulated oil presents a problem.

According to the present invention, there is provided a container or receptacle especially designed to support the spout in an upright position, lower end down. Means is provided at the lower end of the container to relatively tightly receive the spout so that it does not rattle around in the container, which is significant when the container is carried in the vehicle, as on extended trips or if the vehicle is an "oil burner". A lid or cover is provided with sealing means to prevent the escape of accumulated oil and the entrance of contaminating matter. The bottom of the container has an oil drain with a removable closure for easily draining the accumulated oil. In one form of the invention, a drain tube may be connected to the drain outlet for leading oil to a larger container. The spout-containing receptacle may be conveniently carried in some compartment of the vehicle and may be removably mounted on a compartment wall. The mounting means is also available for mounting the container on the wall of a garage, for example. Further features will appear as several forms of the invention are disclosed in detail in the ensuing specification and accompanying drawings.

DESCRIPTION OF THE DRAWINGS

FIG. 1 is a perspective of one form of improved container.

FIG. 2 is an enlarged vertical section through the container, showing a typical spout mounted therein.

FIG. 3 is a fragmentary exploded view showing the upper part of the container, lid and relationship thereto of the top end of the spout.

FIG. 4 is a plan view showing suitable means for mounting the container on a wall.

FIG. 5 is a fragmentary view showing a modified form of spout support.

FIG. 6 is a plan view of the structure shown in FIG. 5.

FIG. 7 is a fragmentary sectional view showing a modified form of seal for the lid.

FIG. 8 is a fragmentary section showing a form of hinged lid.

FIG. 9 is a fragmentary section showing a tube attached to the oil drain outlet.

BEST MODE FOR CARRYING OUT THE INVENTION

Figure 11:
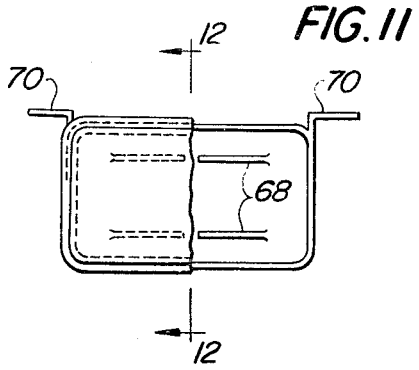
FIG. 11 is a section on the line 11—11—11—11 of FIG. 10.

The container chosen for purposes of illustration may be constructed of relatively rigid, transparent plastic of any of the known types; although, any suitable material may be used. The container has a bottom 10 and wall means 12 rigid with the bottom and rising therefrom to an open top 14 which is closed by a removable lid 16. In that form of container shown in FIGS. 1 and 2, a spout support means 18 is disposed within the container in spaced relation above the bottom 10 and this construction affords an oil reservoir 20. The support 18 may be a flat member of the same material of which the container per se is made and has a transverse slot 22 therein for purposes to presently appear.

Shown received in the container via its open top is a typical pouring spout 24 which has a top or pouring end 26 and a lower can-piercing end 28 comprising a cutter leg 30 and an outer leg 32 which typically closely fits the exterior of the can in juxta-positioned relation to the cutter so that the spout temporarily becomes part of the can. As will be seen, when the spout is inserted into the container it assumes a generally upright position, lower end down and with the lower end 28 relatively tightly fitting the slot 22 in the support 18. The spaced relationship of the support to the bottom of the container is such that the lower end 28 drains into the reservoir 20. The bottom has drain means 34 including an inlet 36 leading from the reservoir and an outlet 38. The outlet is normally closed by a suitable closure means 40, which may be threaded onto the drain outlet. As shown in FIG. 9, the closure may be removed and a drain tube 42 may be connected to the outlet for carrying oil to a larger container (not shown) for example.

A further feature of the invention is that the height of the wall means 12 is chosen so that the received spout has its top end 26 projecting somewhat above the periphery of the open top 14. This enables the user to more easily grasp the spout for removal thereof from the container. The lid 16 has a marginal depending wall 44 which preferably has a friction fit with the open end of the container, and this wall has sufficient height or depth to provide adequate contact with the periphery of the top of the container. The interior of the lid has a spacer means 46 for abutting the top end of the container so that the lid does not rock on the projecting upper end of the spout. See especially FIG. 3.

FIG. 7 shows a modification in which a seal means 48 of the labyrinth type is provided between the lid and the top of the container. The seal includes a modified form of depending marginal wall **42*a* which forms a tongue cooperable with a groove 50 in a modified form of side wall means 12*a***. It will be understood, of course, that the seal is peripheral.

FIG. 8 shows a modification in which a lid 16*b* is connected to the top of the container end by hinge means 52. In this case, any suitable seal may be used, such as a gasket, not shown.

FIG. 9 shows one form of means by which the container may be mounted on a wall, represented at 54, which may be the wall of a garage, for example, or a wall of a vehicle compartment in which the container and spout may be carried. The means includes a bracket 56 having a suitable means, not shown, for attachment to a wall and a strap 58, which may be of any form, such as an elastic band, etc.

FIGS. 5 and 6 show a modified form of spout support means 18*a* located at the lower end of the container. In this case, the means 18*a* comprises a pair of upright plate-like members 18*b* spaced apart transversely of the container and rigidly joined to the container bottom. The members respectively have alined slots 18*c* into which the lower end 28 of the spout is relatively tightly receivable. The spaces around and between the members provide an oil reservoir as before described.

Figure 12:
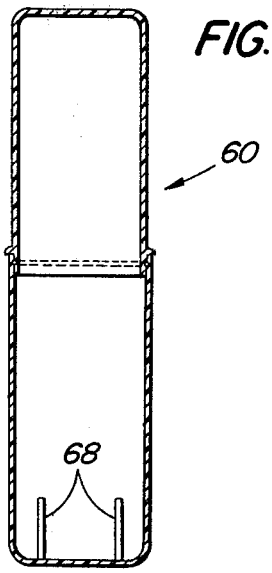
FIG. 12 is a section on the line 12—12 of FIG. 11.
Figure 10:
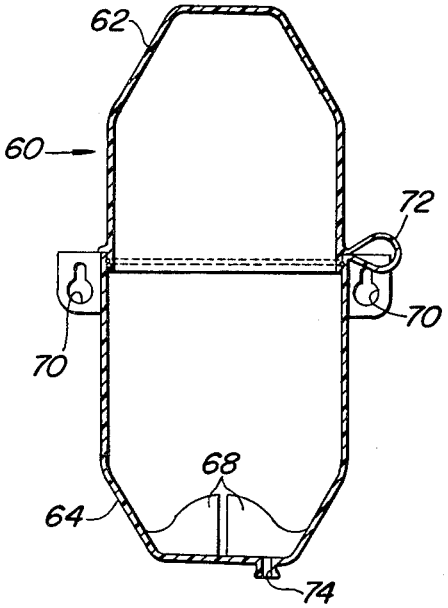
FIG. 10 is a vertical sectional view of a still further modified form of container.
Figure 13:
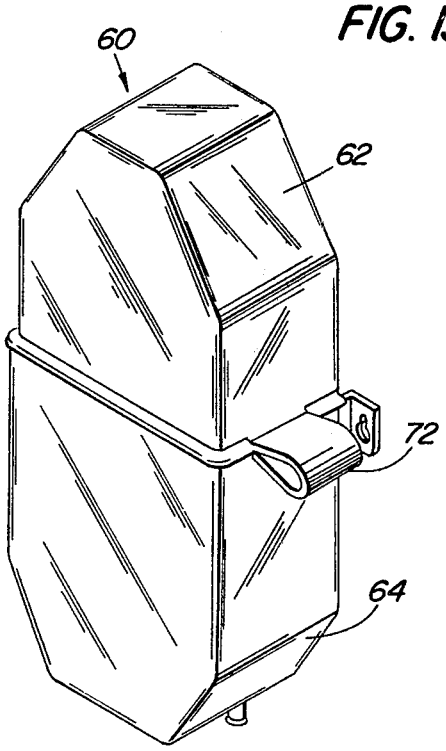
FIG. 13 is a perspective of the form shown in FIGS. 10–12.

In the form of invention shown in FIGS. 10–13, the container is made up of upper and lower parts, thus being of multi-part construction to form a receptacle having the dimensional and functional characteristics of the form referred to before. The container as a whole is designated 60 and is made up of upper and lower parts 62 and 64 respectively. The bottom or lower part is essentially cup-like and the top is in the form of an inverted cup, the two parts interfitting and a junction 66 provided with a seal 68. The bottom of the lower part has means 68 for receiving the lower end of a spout as in FIG. 2, which will be clear without elaboration. Actually the means 68 is symmetrically arranged so that the spout may be inserted in either of two positions diametrically opposed about its lengthwise axis. The bottom further has a pair of apertured ears 70 by means of which the container may be mounted on a wall, panel, etc. A strap 72 joins the upper and lower parts in order to prevent complete separation of one from the other when the upper part is removed to permit access to the interior of the container. An oil drain is provided at 74, and the bottom slopes toward this drain so as to facilitate drainage of oil that has dripped off the used spout.

Features and advantages of the invention beyond those specifically pointed out will become apparent to those versed in the art, as will many modifications, all of which may be achieved without departure from the spirit and scope of the invention.

I claim:

1. For use with an oil can spout of the type having a lower can-piercing end and an upper pouring end; a multi-part container having upper and lower parts which when assembled includes a bottom, top and upright walls extending between and joined to the top and bottom, at least said bottom part being cup-like and the top providing an upper, removable closure for said bottom, said assembled parts being of such height and cross-sectional dimensions as to receive and enclose the spout lower end down and with its upper end adjacent the top of the container, spout support means rigid with the container and spaced above the bottom to provide an oil reservoir, said support means being formed to receive the lower end of the spout and oil drain means in communication with the oil reservoir and having an outlet end exteriorly of the container and removable closure means for the outlet end of the drain means.

2. A container as defined in claim 1, including seal means cooperative between the container upper and lower parts.

3. A container as defined in claim 2, in which the seal means is of the labyrinth type including cooperative tongue and groove means.

4. A container as defined in claim 1, in which the support means is a generally horizontal plate-like member having slot means therein for receiving the lower end of the spout.

5. A container as defined in claim 1, in which the support means comprises a pair of generally upright plate-like members joined to the container bottom and spaced apart cross-wise of the container, said members respectively having cross-wise alined, upwardly opening slots for receiving the lower end of the spout.

6. A container as defined in claim 1, in which hinge means joins the upper and lower parts of the container.

7. A container as defined in claim 1, in which the top of the container is of such height that the upper end of the container-supported spout projects above the container top and the upper part is of such depth as to accommodate said projecting upper end and still interfit with the container lower part.

* * * * *